United States Patent [19]

Lang

[11] Patent Number: 4,528,545

[45] Date of Patent: Jul. 9, 1985

[54] MULTI-POSITION RETURN TO CENTER POTENTIOMETER

[75] Inventor: Warren R. Lang, Glendale, Ariz.

[73] Assignee: Sperry Corporation, New York, N.Y.

[21] Appl. No.: 574,756

[22] Filed: Jan. 26, 1984

[51] Int. Cl.[3] ..... H01C 1/02; H01H 19/58; H01H 9/28; H01H 27/06

[52] U.S. Cl. ..... 338/184; 338/199; 338/202; 200/11 C; 200/67 C; 200/291

[58] Field of Search ..... 338/184, 182, 199, 202, 338/118, 160, 162, 166; 200/11 C, 67 C, 291; 74/527

[56] References Cited

U.S. PATENT DOCUMENTS 3,515,832 6/1970 Martin ..... 200/291 X 3,539,737 11/1970 Schupp ..... 200/11 C

FOREIGN PATENT DOCUMENTS 650113 7/1964 Belgium ..... 200/11 C 1164433 9/1969 United Kingdom ..... 200/11 C

*Primary Examiner*—Roy N. Envall, Jr.

*Assistant Examiner*—C. N. Sears

*Attorney, Agent, or Firm*—Howard P. Terry; Martin G. Anderson

[57] ABSTRACT

A multi-position return to center potentiometer having a multiple detent configuration wherein the center detent position is a dimple and other detent positions provide a resistance to rotation that is greater during rotation away from center than rotation toward the center allowing the use of a small return to center spring.

1 Claim, 4 Drawing Figures

MULTI-POSITION RETURN TO CENTER POTENTIOMETER

BACKGROUND OF THE INVENTION

1. Field of the Invention

The present invention relates to miniature multi-position return to center potentiometers.

2. Description of the Prior Art

Rotary potentiometers that return to their center position after being displaced are well known. Typically, a ball held in position by a spring encounters one or more detents. When the necessary torque is applied to the potentiometer shaft, the ball is forced out of a detent and the shaft is rotated to next the desired detent. When the shaft is released, a return spring provides the necessary torque to force the ball out of the detent and return the shaft of the potentiometer to its center position detent. In the typical configuration, the torque required from the return spring must be of the same general magnitude as the torque required to rotate the shaft from its center detent position.

In those applications where the space available for the potentiometer is severely limited, such as in aircraft instrument panels, the return spring cannot be made large enough to generate the required torque to return the potentiometer to its center position. Making the detents smaller so as to require less torque from the return spring is generally unacceptable. The knowledge of the position of the potentiometer imparted by the positive feel of the detent is an essential part of its function. The present invention provides a detent configuration that permits the use of a very small return spring while retaining the needed positive feel of each detent.

SUMMARY OF THE INVENTION

The miniature multi-position return to center potentiometer of the present invention comprises a multiple detent configuration wherein the center position detent has a dimple and requires equal torque to move the potentiometer shaft either clockwise or counterclockwise.

Other detent positions of the present invention require a predetermined torque to overcome the detent when rotating the shaft away from the center position and a substantially lower torque to return the shaft to the center position. The unique shape of detents comprising one or more channels of different radius and a transition region, makes possible the use of a very small, low torque return spring thereby permitting the miniaturization of the present invention.

DESCRIPTION OF THE PREFERRED EMBODIMENT

Figure 1:
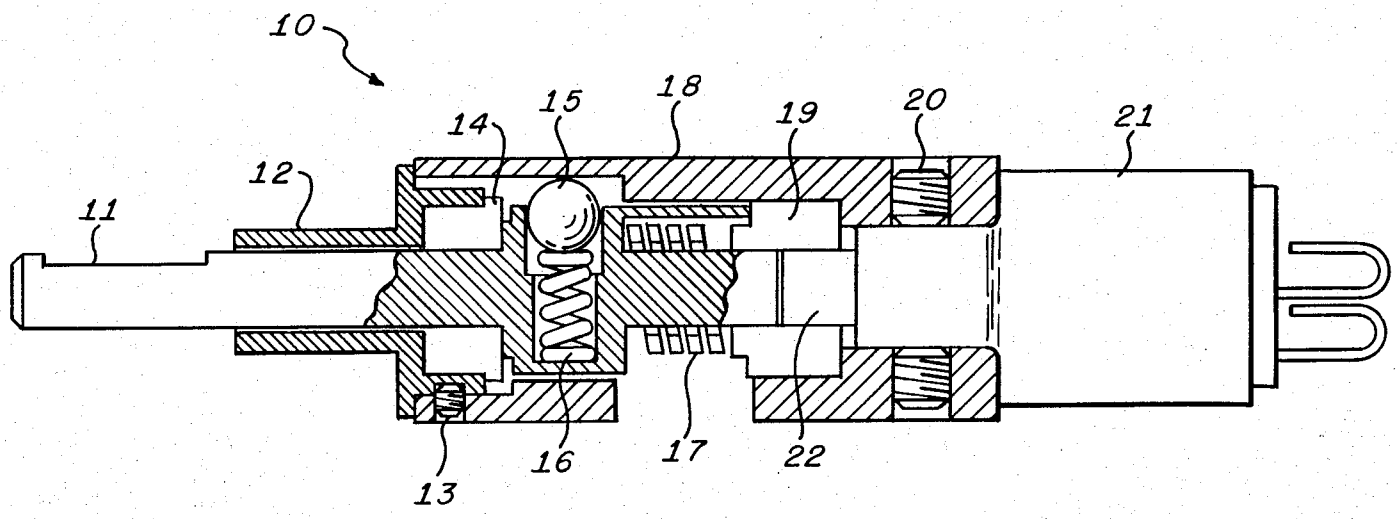
FIG. 1 is a longitudinal cross-section diagram of the multi-position return to center potentiometer.

A diagram of the miniature multi-position potentiometer 10 is shown in FIG. 1. Shaft 11 passes through an end cap 12 which is secured to housing 18 with set screw 13 threaded through housing 18 and contacting end cap 12. Ball bearing assembly 14 which is pressed in end cap 12 supports and facilitates rotation of shaft 11 within housing 18. A channel is cut in shaft 11 into which spring 16 is placed. Ball 15 compresses spring 16 which holds ball 15 against housing 18. Ball 15 contacts detents in housing 18 which will be discussed subsequently. Torsion spring 17 encircles shaft 11. One end of spring 17 is held stationary by housing 18 while the opposite end, not shown, rotates with the rotation of shaft 11 compressing spring 17 and providing a torsional force for returning shaft 11 to its center position which will be discussed subsequently. Bushing 19 is press fit into housing 18 and supports shaft 11 and potentiometer shaft 22. The opposing, ends of shaft 11 and shaft 22 are slotted, not shown, to mate with each other such that rotation of shaft 11 causes like rotation of shaft 22. Set screw 20 is threaded through housing 18 and holds the body of potentiometer 21 in place. Potentiometer 21 may be any of a number of commercially available types of suitable physical and electrical dimensions.

Figure 2C:
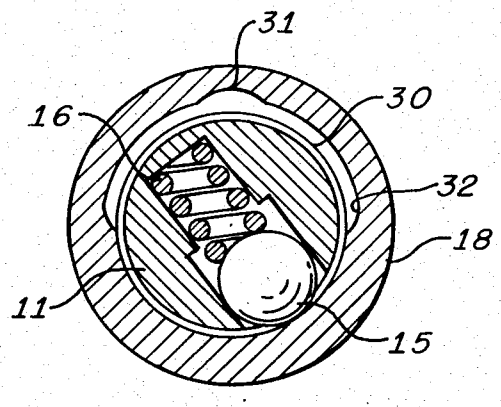
FIG. 2C is a diagram of the detents and potentiometer shaft at a second selected position.
Figure 2B:
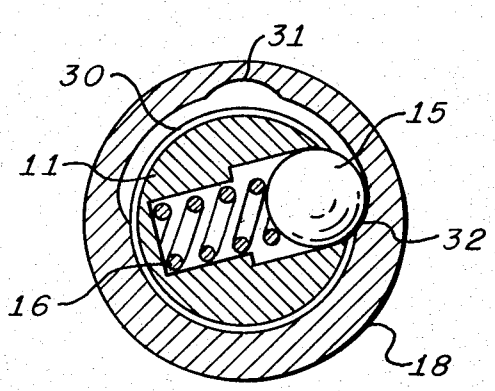
FIG. 2B is a diagram of the detents and potentiometer shaft at a first selected position.
Figure 2A:
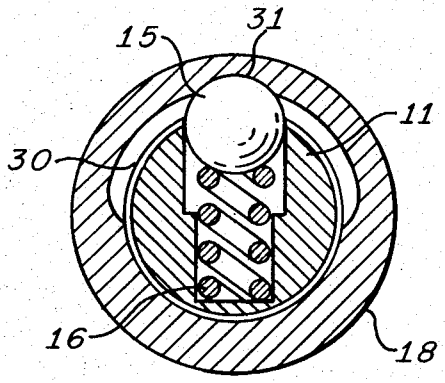
FIG. 2A is a diagram of the detents and potentiometer shaft at the center position.

Referring now to FIG. 2, the details of the detent configuration ill be discussed. in FIG. 2A, shaft 11 containing spring 16 and ball 15 is shown in the center positin resting in dimple shaped detent 31. From the center position, a predetermined amount of torque applied shaft 11 is required to rotate shaft 11 either clockwise or counterclockwise. Detent 31 gives a positive feel that shaft 11 is in its center position. When a sufficient breakaway torque is applied to shaft 11, ball 15 is forced out of detent 31 and into channel 30 which has been fored in housing 18. Rotation continues until detent 32 is encountered, again imparting to shaft 11, a positive feel that a predetermined position has been reached. A further increase in torque applied to shaft 11, causes ball 15 to be forced past detent 32 and rotation may continue until the limit of rotation for potentiometer 21 is reached.

It is to be appreciated that although a total of five possible positions are depicted in FIGS. 2A, B and C, further detents are possible by forming multiple channels of different radius in housing 18.

When the torque applied to shaft 11 is removed, as when a human operator releases the shaft, spring 17 causes shaft 11 to return to center position 31. However, since the shape of detent 32 provides substantial resistance to rotation only in one direction, spring 17 can be smaller and lighter than would otherwise be possible. In the preferred embodiment, housing 18 may be less than 0.5 inches in diameter. Typical torques required for operation are $2\pm0.5$ inch-ounces to break out of detent 31, $6\pm2$ inch-ounces to break out of detent 32 and a maximum of 1 inch-ounce to return shaft 11 to the center position in detent 31.

While the invention has been described in its preferred embodiment, it is to be understood that the words which have been used are words of description rather than of limitation and that changes may be made within the purview of the appended claims without departing from the true scope and spirit of the invention in its broader aspects.

I claim:

1. An apparatus for providing detents in multi-position potentiometers consisting essentially of:

a hollow cylindrical housing having an inner surface with a first arcuate region of a first constant radius about a first center traversing a predetermined angular range, a second arcuate region with first and second sections having a second constant radius about said first center greater than said first radius, symmetrically positioned about a dimple and a curved first and second transition region with constant equal radii about second and third centers connecting said first and second arcuate regions respectively, a cylindrical shaft positioned to rotate within said housing and, means within said shaft for providing pressure contact with said inner surface, whereby a greater resistance to rotation is realized in one direction of rotation than in an opposite direction in said transition regions said shaft has a slot therein having top and bottom and pressure means including: a spring having a first end in contact with said bottom of said slot, a ball in contact with second end of said spring substantially contained at the top of said slot providing compression for said spring, and in pressure contact with said inner surface, and a spring wound concentrically around said cylindrical shaft for rotating said shaft, from an off-set position, until said ball is disposed adjacent to said dimple.

* * * * *